US005269485A

United States Patent [19]

Dwinell et al.

[11] Patent Number: 5,269,485

[45] Date of Patent: Dec. 14, 1993

[54] ADHESIVE FASTENING DEVICE

[76] Inventors: Dr., San Jose, Calif. 95120; Raymond E. Parton, 671 E. Olive Ave. #1, Sunnyvale, Calif. 94086; Michael J. Dikas, 60 Williams St., San Carlos, Calif. 94070

[21] Appl. No.: 940,693

[22] Filed: Sep. 4, 1992

[51] Int. Cl.[5] ..... F16L 3/08

[52] U.S. Cl. ..... 248/216.4; 40/668; 248/205.3

[58] Field of Search ..... 248/216.1, 216.4, 217.3, 248/218.1, 218.2, 205.3, 205.4, 467; 40/668, 594, 1.5

[56] References Cited

U.S. PATENT DOCUMENTS

| | | | |
|---|---|---|---|
| 412,046 | 10/1889 | Sheifer . | |
| 543,644 | 7/1895 | Chenewith . | |
| 1,202,412 | 10/1916 | O'Donnell . | |
| 1,297,016 | 3/1919 | Schoenl . | |
| 1,860,384 | 5/1932 | Cocks . | |
| 4,422,608 | 12/1983 | Hogg | 248/216.4 X |
| 4,860,402 | 8/1989 | Dichtel | 16/4 |
| 5,029,788 | 7/1991 | Hoskinson et al. | 248/218.1 |
| 5,121,896 | 6/1992 | Frye | 248/205.3 X |

FOREIGN PATENT DOCUMENTS 0009354 of 1893 United Kingdom .

*Primary Examiner*—Ramon O. Ramirez
*Attorney, Agent, or Firm*—Michael J. Hughes

[57] ABSTRACT

An adhesive fastening device (10) having a plate (12) and a pin component (16) and an adhesive tape (14). The adhesive fastening device (10) is adapted for attaching and supporting an object piece (44) or equivalent thereof to an office cubicle wall (46). The pin assembly (16) has two rear leg portions (32) for insertion through a cloth covering (48) of the cubicle wall (46), thereby attaching the adhesive fastening device (10) to the cubicle wall (46). An adhesive tape (14) is secured to the plate (12) by a first adhesive portion (18) and an object piece (44) is removably affixed to the plate (12) by a second adhesive portion (22) of the adhesive tape (14). A removable paper cover (42) is provided to prevent unwanted adherence to the adhesive tape (14) prior to end use. A pair of pin abutting projections (26) project from the rear of the plate (12) for holding the plate (12) generally parallel to the cubicle wall (46) when the rear leg portions (32) are inserted through the cloth covering (48) of the cubicle wall (46).

10 Claims, 3 Drawing Sheets

ADHESIVE FASTENING DEVICE

TECHNICAL FIELD

The present invention relates generally to hardware accessory devices and more particularly to a device for attaching objects to a fabric covered surface. The predominant current usage of the adhesive fastening device of the present invention is as a means for hanging pictures and the like on cloth covered office cubicle partitions.

BACKGROUND ART

Various types of pins and clips for securing objects together have been known in the art for centuries. Being relatively simple devices, a great many variations have been developed, and these have been applied to an almost limitless variety of applications. A number of such variations, most of which have been adapted for fairly narrowly defined purposes, have been found worthy of patent protection.

A subclass of such devices consists of combination type fasteners which serve to connect together two unlike materials. For example, a device may have a clip type apparatus connected to a pin type apparatus. The clip may be adapted for holding a first material, while the pins may be adapted for insertion into a second material. Thus, the first material may be secured to the second material by means of the combination type device. An example of this sort of fastener device is found in U.S. Pat. No. 4,860,402 issued to Dichtel.

Yet another example of combination clip/pin type fasteners which has been found worthy of patent protection is a hanger for hats, garments, and the like which has been disclosed in U.S. Pat. No. 1,860,384 issued to Cocks. The Cocks invention has a pin for connection to a wall panel of an automobile and an asymmetrical spring loaded clip section adapted for holding hats, garments, and the like.

The above referenced examples are by no means exhaustive of the variations of combination type fasteners which have been found worthy of patent protection. Yet another example is to be found in U.S. Pat. No. 1,297,016 issued to Schoenl, wherein a clip portion, rather than being spring loaded, secures objects by means of a screw type apparatus.

Despite the fact that a great variety of fasteners have been developed, new requirements for new and different types of fasteners continue to arise. An example of such a need which has been recognized by the present inventors arises from the difficulty of fastening items to the walls of modern office cubicles without harming either the cubicle walls or the items which are to be hung therefrom. The cubicle walls of concern are usually made from a metal or synthetic backing which is covered with an upholstery type cloth material. A copending application number 07/869,313 assigned to the same assignee as is this present application discloses a combination fastener for attaching items by means of a clip device to cloth covered walls. However, many items which a person might wish to attach to cubicle walls cannot be readily grasped by such a clip device. Furthermore, a clip is most appropriate for holding items which must be repeatedly attached thereto and detached therefrom. A clip is both unnecessary and unsightly in many applications where something is to be attached on a more permanent basis.

It happens that many items are available in the market which an office worker might wish to fasten to the walls of his or her office cubicle. A large portion of these, such as small digital clocks, plastic framed pictures, and the like, cannot readily be fastened to such walls without the use of glue or tape, and this may be prohibited by office policy since it may permanently damage the walls. To the inventors' knowledge, no prior art means is available for fastening objects which cannot readily be supported by a pin or clip type fastener to an cloth covered office cubicle wall.

All of the prior art fastening devices within the inventor's knowledge which one might attempt to employ for the purpose have either required that an object be pinned through, clipped into, or hung from the fastening device. The only alternative available has been to fasten the object to the wall with an adhesive glue, tape, or the like. No prior art fastening device, to the inventors' knowledge, has provided a means for fastening objects which cannot be readily pinned, clipped or hung to cloth office cubicle walls without damaging either the walls or the object to be affixed thereto.

DISCLOSURE OF INVENTION

Accordingly, it is an object of the present invention to provide a means for hanging items from an office cubicle wall which will not harm the office cubicle wall.

It is another object of the present invention to provide a means for hanging items from an office cubicle wall which will not harm the items to be hung.

It is still another object of the present invention to provide a means for hanging items from an office cubicle wall which will support items that cannot be pinned or clipped to the cubicle wall.

It is yet another object of the present invention to provide a means for attaching items to an office cubicle wall which means is not visually apparent when in use.

It is still another object of the present invention to provide a means for hanging items from an office cubicle wall which will tend to resist twisting in relation to the office cubicle wall even if weight is distributed unevenly thereon.

It is yet another object of the present invention to provide a means for hanging items from an office cubicle wall which will assist in preventing items from hanging unevenly in relation to the wall.

It is still another object of the present invention to provide a means for hanging items from an office cubicle wall which is inexpensive to manufacture and reliable in operation.

Briefly, the presently preferred embodiment of the present invention is a fastening device having a flat plate portion with an adhesive on one side thereof for attaching to objects to be hung therefrom. A pin apparatus is connected to the flat plate such that the flat plate may be attached to an office cubicle wall thereby and, further, such that objects connected to the flat plate by the adhesive are thereby connected to the cubicle wall in such a manner that the object is prevented from twisting or turning in relation to the cubicle wall.

An advantage of the present invention is that an office cubicle wall is not harmed when hanging items therefrom.

A further advantage of the present invention is that items need not be pierced, taped, or otherwise altered or harmed in order to hang them from office cubicle walls.

Yet another advantage of the present invention is that pictures and the like hung from office cubicle walls can be prevented from shifting so as to prevent them from hanging unevenly in relation to the wall.

Still another advantage of the present invention is that the means for hanging items from office cubicle walls is inexpensive to manufacture and reliable in operation.

Yet another advantage of the present invention is that objects which cannot readily be pinned or clipped can be hung from office cubicle walls.

These and other objects and advantages of the present invention will become clear to those skilled in the art in view of the description of the best presently known mode of carrying out the invention and the industrial applicability of the preferred embodiment as described herein and as illustrated in the several figures of the drawing.

BEST MODE FOR CARRYING OUT INVENTION

The best presently known mode for carrying out the invention is an adhesive fastening device. The predominant expected usage of the inventive adhesive fastening device is in the office environment, particularly in offices having cloth covered cubicle dividers wherein an ability to hang various items from the cubicle divider walls without harming either the walls or the items to be hung is desirable.

Figure 1:
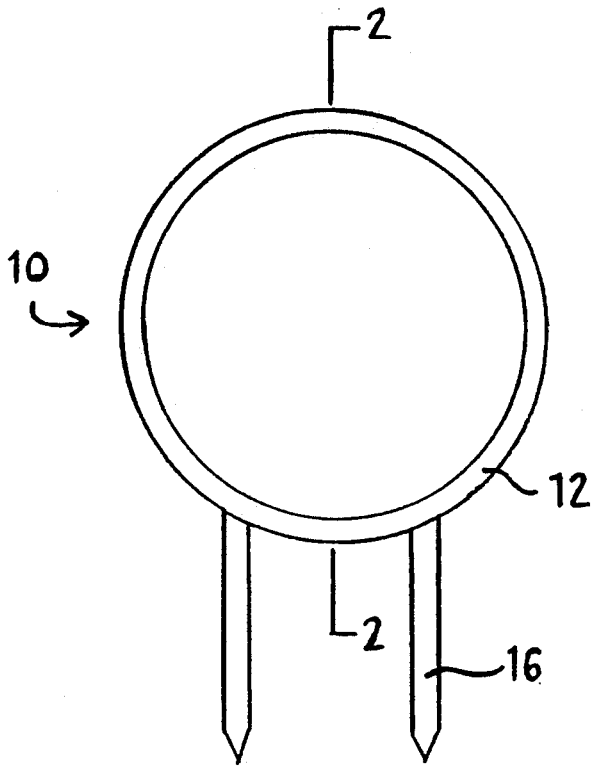
FIG. 1 is a front elevational view of an adhesive fastening device, according to the present invention.

The adhesive fastening device of the presently preferred embodiment of the present invention is illustrated in a front elevational view in FIG. 1 and is designated therein by the general reference character 10. The adhesive fastening device 10 has a plate 12 with an adhesive tape 14 affixed thereto, and a pin component 16 which is only partially visible in the view of FIG. 1. As can be seen in the view of FIG. 1, the plate 12 of the best presently known embodiment 10 of the present invention is generally round in shape, although this shape is arbitrary and other shapes, such as square or rectangular, are within the scope of the invention. The pin component 16 according to the best presently known embodiment 10 of the present invention is formed from a single piece of spring wire, as will be described in more detail hereinafter.

Figure 2:
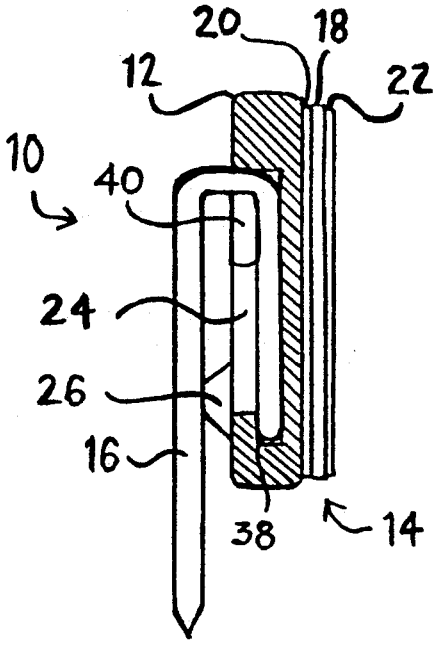
FIG. 2 is a cross sectional view of the adhesive fastening device of FIG. 1 taken along line 2—2 of FIG. 1.

FIG. 2 is a cross sectional view of the adhesive fastening device 10 taken along line 2—2 of FIG. 1. In the view of FIG. 2 it can be seen that the adhesive tape 14 has a plastic tape portion 18, a first adhesive portion 20, and a second adhesive portion 22. The first adhesive portion 20 and the second adhesive portion 22 are formed on the plastic tape portion 18 such that the adhesive tape 14 is of a "two sided" variety, with the fist adhesive portion 20 holding the plastic tape portion 18 to the plate 12 and the second adhesive portion 20 facing away from the plate 12.

In the best presently known embodiment 10 of the present invention, the plate 12 is a molded plastic piece, although other materials and methods of construction might be employed. The plate 12 is formed with a pin holding recess 24 therein and two pin abutting projections 26 (only one of which is visible in the view of FIG. 2) projecting therefrom.

Figure 3:
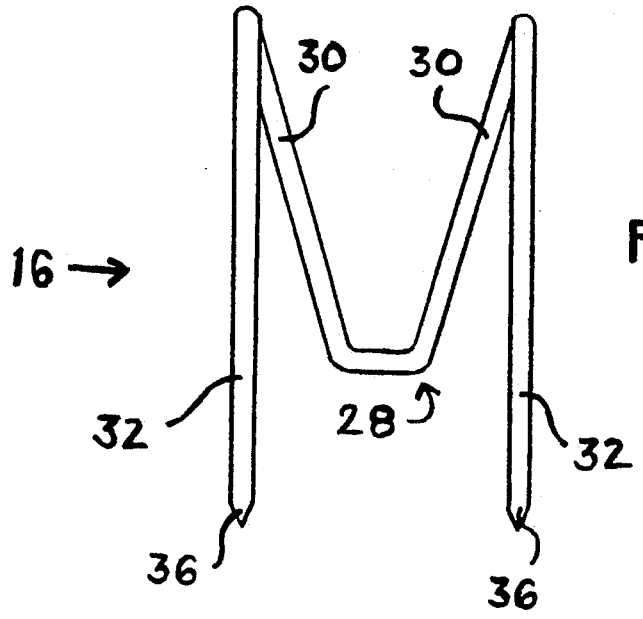
FIG. 3 is a rear elevational view of a pin component of the present invention.
Figure 4:
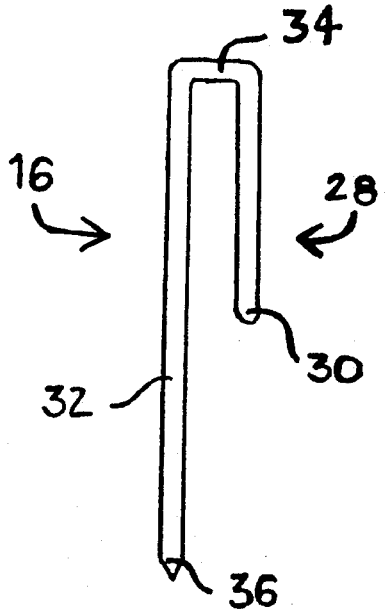
FIG. 4 is a side elevational view of the pin component of FIG. 3.

FIG. 3 is a rear elevational view of the pin component 16 and FIG. 4 is a side elevational view of the pin component 16. By comparing the views of FIG. 3 and FIG. 4, one skilled in the art can see that the pin component 16 is bent into a relatively complex shape. A front portion 28 has two front leg portions 30. Two rear leg portions 32 are joined to their respective front leg portions 30 by a pair of top portions 34 (only one of which is visible in the view of FIG. 4). The rear leg portions 32 are longer than the front leg portions 30, and each of the rear leg portions 32 is terminated with a sharpened point 36. Since, as has been previously discussed herein, the pin component 16 is, constructed from spring steel wire, the pin component 16 can be bent slightly from the shape depicted in the views of FIGS. 3 and 4 and will tend to return to the shape there depicted. In their normal (unstressed) position the rear leg portions 32 are generally parallel to each other such that they can easily be inserted simultaneously into a material (not shown).

Figure 5:
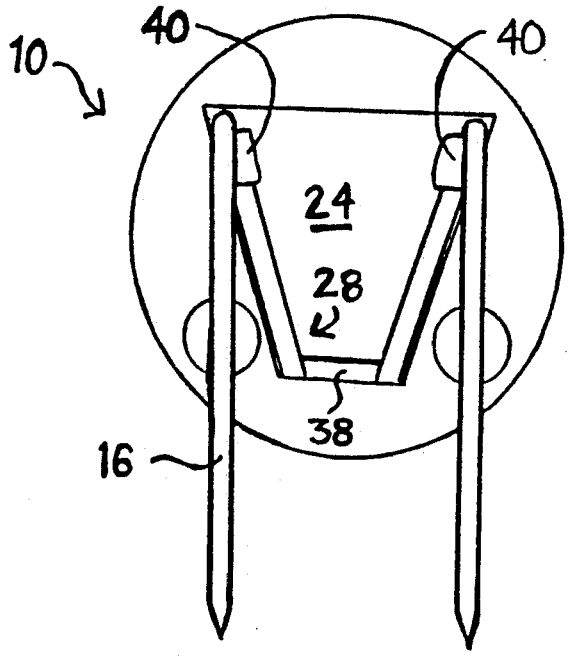
FIG. 5 is a rear elevational view of the adhesive fastening device of FIG. 1.

FIG. 5 is a rear elevational view of the best presently known embodiment 10 of the present invention. As can be seen in the view of FIG. 5, when the front portion 28 of the pin component 16 is inserted into the pin holding recess 24, the front portion 28 (not visible in the view of FIG. 5) of the pin component 16 is within a pocket 38 formed in the pin holding recess 24 of the plate 12. The front leg portions 30 are held in place within the pin holding recess 24 by a pair of tabs 40 which are formed on the plate 12 for that purpose, as illustrated in FIG. 5. One of the tabs 40 is also visible in the view of FIG. 2. As can be appreciated, to assemble the adhesive fastening device, the front portion 28 of the pin component 16 is first inserted into the pocket 38 and then the pin component 16 is stressed such that the two top portions 34 are temporarily moved closer together, thus allowing the two front leg portions 30 to be moved past the tabs 40 fully into the pin holding recess 24. Then, the stress is removed from the pin component 16 such that it returns to its normal unstressed shape (FIGS. 3 and 4), whereby the front leg portions 30 are moved behind their respective tabs 40 this preventing the pin component 16 from becoming inadvertently detached from the plate 12.

Figure 6:
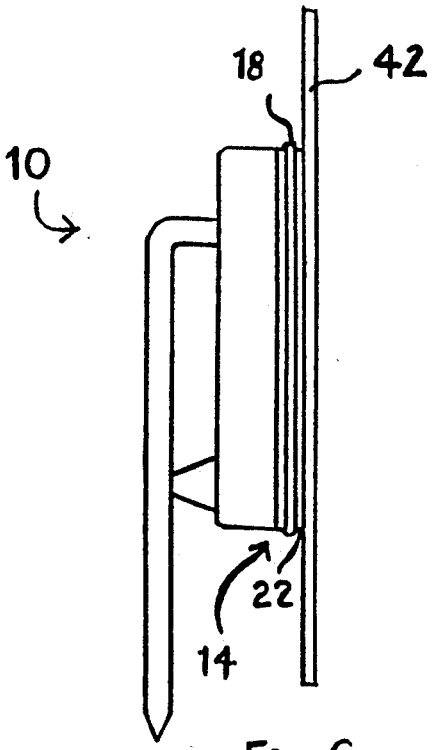
FIG. 6 is a side elevational view of the adhesive fastening device showing a removable paper cover in place thereon.

FIG. 6 is a side elevational view of the best presently known embodiment 10 of the present invention showing a temporary paper cover 42 in position against the second adhesive portion 22 of the adhesive tape 14. The paper cover 42 of the best presently known embodiment 10 of the invention is made of a waxed paper material, although any of several materials might be used for the purpose. The required characteristic of the paper cover 42 is that it adhere sufficiently to the adhesive tape 14 that it will not accidentally become detached therefrom, but also that it is easily detached from the adhesive tape 14 by the end user when required. The purpose of the paper cover 42 is to protect the second adhesive portion 22 of the adhesive tape 14 from becoming contaminated at to keep it from accidentally becoming adhered to foreign objects prior to usage. The paper cover 42 is intended to be removed by the end user when the adhesive fastening device 10 is used.

Figure 7:
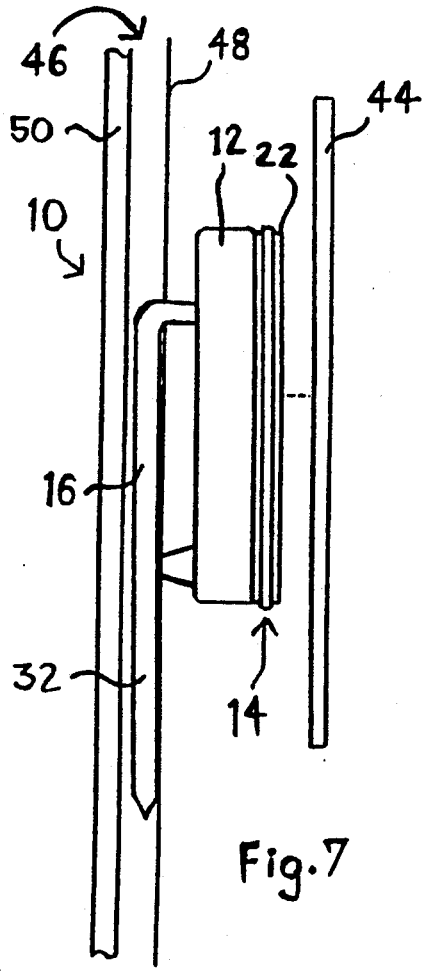
FIG. 7 is a side elevational of the adhesive fastening device, similar to the view of FIG. 7, showing the adhesive fastening device in place on a wall and with an object piece in relation thereto.

FIG. 7 is an exploded side elevational view of the best presently known embodiment 10 of the present invention showing a typical application thereof wherein an object piece 44 (selected by the end user, such as a picture, small clock, etc.) is to be attached to a cubicle wall 46. In the view of FIG. 7, the rear leg portions 32 of the pin component 16 has been inserted through an outer cloth covering 48 of the cubicle wall 46 and positioned between the cloth covering 48 and a metal back panel 50. The plate 12 is held generally parallel to the cubicle wall 46 by the pin abutting projections 26. In the view of FIG. 7, the paper cover 42 (FIG. 6) has been removed from the adhesive fastening device 10 and the object piece 44 is shown in position to be attached to the adhesive fastening device 10 by moving the object piece 44 against the second adhesive portion 22 of the adhesive tape 14.

As is shown above, in great part, the adhesive fastening device 10 according to the present invention resembles prior art fastener devices in some respects. Among the substantial differences are the inclusion of the adhesive tape 14 and the inventive plate 12 and pin component 16 which, in combination, hold the adhesive tape 14 such that it can be used to hold the object piece 44 without damaging the cubicle wall 46, and further such that the object piece 44 is held parallel to the cubicle wall 46 and is prevented from twisting or turning in relation to the cubicle wall 46. No significant changes of materials are envisioned nor are any special constructions required.

Various modifications may be made to the invention without altering its value or scope. For example, the shape of the plate 12 could be altered, the pin component 16 could be constructed from separate pieces of wire instead of the single piece as described herein, and the means for attaching the pin component 16 to the plate 12 could be altered. Similarly, an adhesive coating could be applied directly to the plate 12 instead of using the adhesive tape 14, as described herein.

All of the above are only some of the examples of available embodiments of the present invention. Those skilled in the art will readily observe that numerous other modifications and alterations may be made without departing from the spirit and scope of the invention. Accordingly, the above disclosure is not intended as limiting and the appended claims are to be interpreted as encompassing the entire scope of the invention.

INDUSTRIAL APPLICABILITY

The adhesive fastening device 10 is adapted to be widely used in business environments for hanging various items from the walls thereof. The predominant current usages are for hanging items from the cubicle walls 22 of office cubicles having cubicle walls 22 constructed with a cloth covering 24 over a metal or synthetic backing board 26.

The inventive adhesive fastening devices 10 can be used in a great variety of office environments and to support a great variety of items from the cubicle walls 22 thereof. I happens that many small and lightweight items are available which one might wish to fasten to the walls of his or her office cubicle. Among these are small clocks, pictures, and the like. Many such items cannot be fastened by means of pins or the like. In such instances, the inventive adhesive fastening devices 10 are appropriate.

To use the adhesive fastening device 10, the user pierces the cloth covering 48 of the cubicle wall 46 with the sharpened points 36 of the rear leg portions 32 of the pin component 16, and then positions the adhesive fastening device 10 in relation to the cubicle wall 46 as depicted in FIG. 7. Then, the paper cover 42 is removed to expose the adhesive tape 14 and the object piece 44 (the object to be hung from the cubicle wall 46) is affixed to the adhesive fastening device 10 (and, thus, indirectly to the cubicle wall 46) thereby. Unwanted twisting or turning of the adhesive fastening device 10 in relation to the cubicle wall 46 is avoided by the fact that the adhesive fastening device 10 is supported by the two separate parallel rear leg portions 32 of the pin component 16 and, further, by the fact that the cloth covering 48 of the cubicle wall 46 is grasped between the rear leg portions 32 and their respective pin abutting projections 26 (FIG. 2). By this means, objects which are most appropriately affixed to the wall 46 by an adhesive substance can be so affixed without harming the wall 46 by the direct application of any adhesive substance.

It is thought that the practice of utilizing the inventive pinned clip support fasteners 10 as opposed to prior art, usually makeshift, methods for suspending objects from the cubicle walls 22 will benefit both employers and employees alike and will, therefore, meet with a great deal of acceptance all concerned parties. Employees will benefit in that their cubicle spaces can be easily decorated with pictures and similar decorative items, and further in that items such as calendars, clip boards, and the like can be can be stored on the wall, thereby clearing desk space for use.

The adhesive fastening device 10 of the present invention may be utilized in essentially any conventional office cubicle. Since the adhesive fastening devices 10 of the present invention may be readily constructed and are suitable for use with existing conventional cubicle walls 46, it is expected that they will be acceptable in the industry as substitutes for the conventional means for hanging items from the cubicle walls 46. For these and other reasons, it is expected that the utility and industrial applicability of the invention will be both significant in scope and long-lasting in duration.

We claim:

1. A fastening device for attaching an object to an office cubicle wall, the office cubicle wall having a cloth covering thereon, the fastening device comprising:

a plate component having a generally flat adhesive surface thereon; and pin means, including two generally parallel pins with pointed ends adapted for piercing the cloth covering of the office cubicle wall, affixed to said plate component for pinning said plate component through the cloth covering of the office cubicle wall, said pin means being adapted such that at least a portion of said pin means can be inserted through the cloth covering of the office cubicle wall and positioned between the wall and the cloth covering such that adhesive surface of said plate component is fixed by said pin means to be generally parallel to the wall.

2. The fastening device of claim 1, wherein:

the flat adhesive surface includes an adhesive tape, the adhesive tape being a tape with a first adhesive side and a second adhesive side, the first adhesive side holding the adhesive tape to said plate component and the second adhesive side being available for attaching the object thereto.

3. The fastening device of claim 1, and further including:

a cover removably attached to the flat adhesive surface of said plate component for preventing the adhesive surface from becoming contaminated prior to use.

4. The fastening device of claim 1, wherein:

said pin means is constructed from a single piece of spring wire; and said plate component includes a plurality of projections formed such that said pin means is affixed to said plate component by the action of temporarily deforming said pin means such that it can be moved past the projections and then allowing said pin means to return to its unstressed shape such that the projections prevent said pin means from moving away from said plate component.

5. The fastening device of claim 1, wherein:

said plate component is formed such that the adhesive surface of said plate component is generally parallel to the office cubicle wall when said pin means employed to pin the fastening device to the cloth covering of the office cubicle wall.

6. In a fastener device for fastening an object to a wall, the wall having a cloth covering over a solid backing, an improvement comprising:

a pin, including two distinct mutually parallel pin projections, each pin projection having a pointed end for inserting through the cloth covering such that a substantial portion of said pin is situated between the cloth covering and the solid backing;

an adhesive portion for adhering to the object to be fastened; and a plate component for connecting said pin to said adhesive portion, wherein:

said pin is extended from said plate component by a top extension portion of said pin and that portion of said pin which is intended for insertion through the cloth covering is generally parallel to the adhesive portion of the fastener device.

7. The improvement of claim 6, wherein said adhesive portion presents a generally flat surface and said plate component is formed such that the generally flat surface of said adhesive portion is held generally parallel to the wall when said pin is inserted between the cloth covering and the solid backing of the wall.

8. The improvement of claim 6, wherein:

said adhesive portion includes a tape, the tape having a first adhesive side and a second adhesive side, the tape being secured to said plate component by said first adhesive side.

9. The improvement of claim 6, and further including:

a removable cover for selectively covering said adhesive portion.

10. In a fastener device for fastening an object to a wall, the wall having a cloth covering over a solid backing, an improvement comprising:

a pin formed from spring wire and having a pointed end for inserting through the cloth covering such that a substantial portion of said pin is situated between the cloth covering and the solid backing;

an adhesive portion for adhering to the object to be fastened; and a plate component, including a plurality of projections adapted for holding said pin, for connecting said pin to said adhesive portion, wherein:

said pin is formed such that it is held against said plate by the projections when said pin is in an unstressed shape and said pin is extended from said plate component by a top extension portion of said pin and that portion of said pin which is intended for insertion through the cloth covering is generally parallel to the adhesive portion of the fastener device.

* * * * *